US006263946B1

(12) United States Patent
Cotten

(10) Patent No.: US 6,263,946 B1
(45) Date of Patent: Jul. 24, 2001

(54) WINDOW COVERING CORD SAFETY ASSEMBLY

(75) Inventor: Fred Cotten, Grass Valley, CA (US)

(73) Assignee: E Z Release, Inc., Sacramento, CA (US)

( * ) Notice: Subject to any disclaimer, the term of this patent is extended or adjusted under 35 U.S.C. 154(b) by 0 days.

(21) Appl. No.: 09/713,510

(22) Filed: Nov. 17, 2000

(51) Int. Cl.[7] ..... E06B 9/38

(52) U.S. Cl. ..... 160/178.1 R; 24/115 F

(58) Field of Search ..... 160/178.1 R, 168.1 R, 160/173 R, 320, 178.2 R; 24/115 F; 16/114.1, 441, 442

(56) References Cited

U.S. PATENT DOCUMENTS 5,715,884 2/1998 Cotten .

*Primary Examiner*—David M. Purol
(74) *Attorney, Agent, or Firm*—Donald E. Nist

(57) ABSTRACT

The window covering cord safety assembly includes at least one window covering control cord bearing an eyelet on its free end, preferably about 4 such cords with eyelets, and a safety device connected to the free end of the control cords through the eyelets and adapted to release all but one of the cords at a predetermined pull pressure. The device includes a closed housing having an upper end having control cord openings, an opposite lower end, interconnecting sidewalls and a generally central space. The upper portion of the space has a larger diameter than the lower portion of the space. A retainer is slideably received in the space for movement between the lower portion and upper portion of the space. The lower portion of the retainer is preferably inverted conical. The retainer has spaced pockets in which the eyelets are received and trapped when the retainer is in the lower portion of the space, but are released when the retainer is in the upper portion of that space. A spring is positioned between the top of the retainer and the top of the housing in the central space, biasing the retainer into the lower portion of the space. A safety rod spans transversly the central space and blocks one of eyelets from escaping the housing. An upper control guide is mounted on the upper end of the housing and has cord holes aligned with the housing openings. The guide keeps the control cords in parallel alignment. All but one of the control cords are released from the housing to free a child from entanglment with the control cords when an operating cord depending from the retainer and housing is pulled down against the spring pressure. The safety device thus provides improved safety and control of the assembly.

8 Claims, 3 Drawing Sheets

WINDOW COVERING CORD SAFETY ASSEMBLY

BACKGROUND OF THE INVENTION

1. Field of the Invention

The present invention generally relates to safety means and more particularly to an improved assembly which prevents children from becoming entangled in window covering control cords and strangling themselves.

2. Prior Art

The dangers of very young children becoming entangled in window covering control cords and strangling themselves is real, as evidenced by publications of the U.S. Consumer Product Safety Commission.

This problem has been addressed by various patents designed to reduce or eliminate such hazards. See, for example, U.S. Pat. Nos. 4,909,298, 5,504,977, 5,494,092 and 5,473,797. All of such devices are relatively complicated and expensive and rely on laterally separating action to cause parts of the devices to separate as a child engtangled in the cords twists and turns to free himself. Unfortunately, the degree of force necessary for such separating action cannot be controlled with any degree of certainty, so that such devices are less than optimal for their intended purposes.

A greatly improved window covering cord safety assembly is set forth in U.S. Pat. No. 5,715,884. This device depends on an internal spring to precisely regulate the force necessary for complete separation of the control cords from the remainder of the device.

However, there remains a need for a further improvement in such devices. Such improvement should be designed so that complete separation of all but one of multiple control cords from the main body of the device occurs at a predetermined force, but which also causes that one control cord to remain attached to the main body of the device so that the main body of the device cannot be removed and become a choking hazard for a young child. There is also a need for an improved cord safety device which facilitates maintaining multiple control cords in proper untangled parallel alignment during operation of the device.

SUMMARY OF THE PRESENT INVENTION

The improved window covering control cord safety assembly of the present invention satisfies all the foregoing needs. The assembly is substantially as set forth in the ABSTRACT OF THE DISCLOSURE. The assembly is simple, inexpensive, durable and efficient, providing a new higher level of safety. It is also easily assembled and disassembled.

Thus, the assembly includes one or more window covering control cords, the lower free ends of which bear expanded portions such as beads, hereinafter referred by the general term eyelets. The assembly also includes a safety device of an improved type. The device has a housing with closed top, bottom and interconnecting sidewalls to define a generally central space within which is disposed a retainer. Preferably, the housing and the upper portion of the retainer are generally cylindrical. The lower ends of the control cords and the eyelets pass down through openings in the top of the housing and engage the retainer which is slideably disposed in the central space.

The upper portion of the central space is expanded relative to the lower portion of the central space. The bottom portion of the retainer is preferably inverted conical and has spaced external pockets for releasably retaining the eyelets and control cord lower ends when the retainer is biased down into the lower portion of the central space by a spring positioned between the top of the retainer and the top of the housing.

In a preferred embodiment a screw passes down through the housing top to adjustably compress the spring and thus control the degree of downward vertical force needed to be exerted in order to allow the retainer to move up in the housing to the upper expanded portion of the central space wherein the cord ends and eyelets are freed from the pockets, causing the cords and eyelets to pass up through the housing and out of the housing, freeing a child entangled in the cords.

The device also includes an operating cord connected to the lower end of the retainer and extending down below the housing, preferably in a tube. The tube, retainer and housing can be made of plastic or other suitable material. The device is easy to install and use and can be easily removed from the control cords, when desired.

The device further includes a novel safety feature in the form of an elongated rod which transversly spans the central space and is positioned and is of sufficient diameter to permit one of the control cords adjacent thereto to slide past it unimpeded but which prevents the full separation of that control cord from the housing because the rod blocks the eyelet of that control cord from passing upwardly by the rod. Instead, the rod traps that eyelet.

Thus, the housing is retained on a single control cord, preventing a child from removing the housing and choking on it. When it is desired to fully separate the housing from all the control cords the rod can be removed from the central space. In order to facilitate releasably locking the rod in the housing, the rod can have an expanded screw-type outer end along with a threaded portion adjacent thereto and receivable within a threaded opening in the housing. The remainder of the rod, that portion which spans the central space, is smooth and cannot abrade the control cord adjacent thereto.

The device preferably also includes an upper cord guide which preferably is generally conical in configuration and which is seated on the top of the housing. The cord guide has spaced passages extending from the top to the bottom of the cord guide, which openings are aligned with the operings in the top of the housing. The cord guide is releasably or permanently secured to the top of the housing. The cord guide keeps the control cords in proper parallel spaced relation for easier operation of the device.

Further features of the present invention are set forth in the following detailed description and accompanying drawings.

DRAWINGS

DETAILED DESCRIPTION

FIGS. 1–5 and 8.

Now referring more particularly to FIGS. 1–5 and 8 of the drawings, a first preferred embodiment of the improved window covering cord safety assembly of the present invention is schematically depicted therein.

Figure 1:
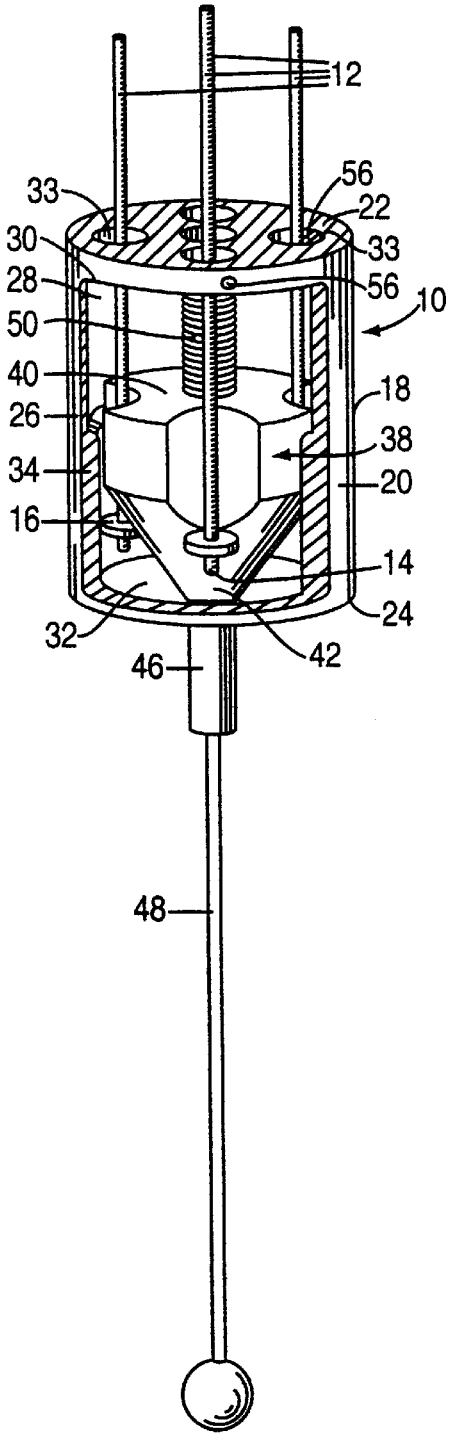
FIG. 1 is a schematic front perspective view, partly borken away, of a first preferred embodiment of the improved assembly of the present invention, shown with the control cord ends and eyelets trapped in pockets in the retainer in the housing, with the retainer biased down by the spring into the lower portion of the central space.
Figure 2:
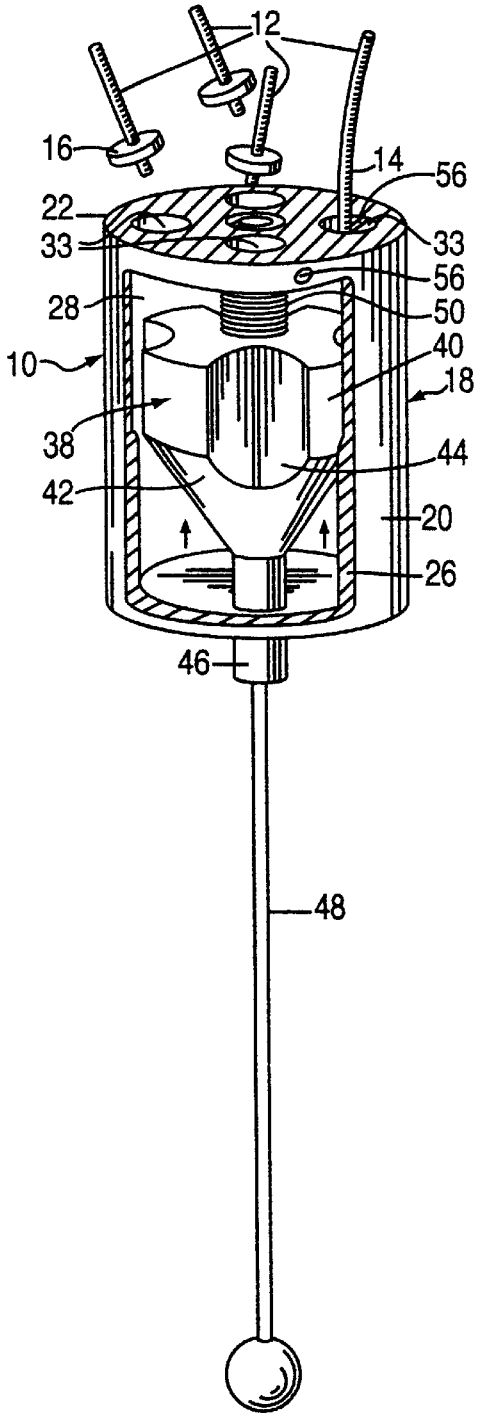
FIG. 2 is a schematic front perspective view, partly broken away, of the assembly of FIG. 1, shown with the retainer in the up position in the upper portion of the central space and with all but one of the control cords and eyelets fully separated from the housing.
Figure 3:
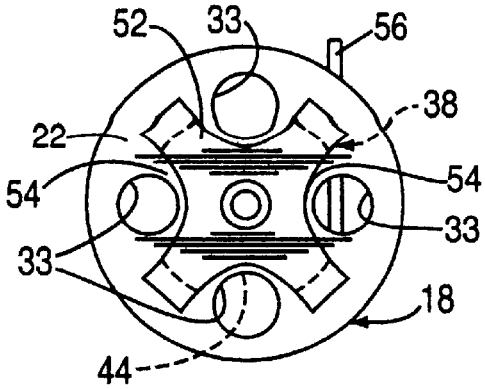
FIG. 3 is a schematic top plan view of the housing and cord guide of the assembly of FIG. 1, with the position of the retainer within the housing shown in phantom outline, the control cords and eyelets not being shown.
Figure 4:
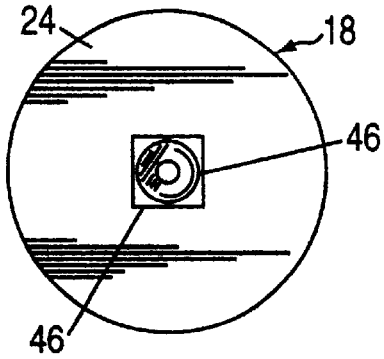
FIG. 4 is a schematic bottom plan view of the housing of FIG. 1.
Figure 5:
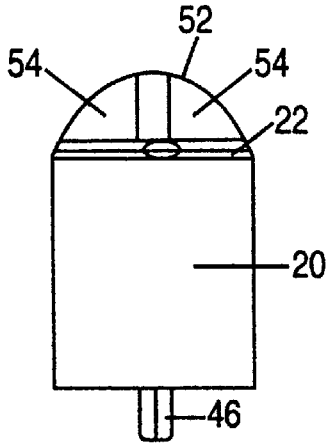
FIG. 5 is a schematic reduced size side elevation of the housing and cord guide of the assembly of FIG. 1.

Thus, assembly 10 is shown which comprises, in combination:

a) four flexible resilient window covering control cords 12 having free lower ends 14 bearing eyelets 16; and, b) an improved safety device 18 shown in FIG. 1 connected to the free lower ends 14 and eyelets 16. In FIG. 2 device 18 is shown with all but one of the control cords 12 separated from safety device 18. Safety device 18 includes, in combination, the following components:

1) A preferably generally cylindrical housing 20 is utilized in the assembly and includes a closed upper end 22, a closed opposite bottom end 24 and sidewalls 26 interconnecting top 22 and bottom 24 to define therewith a generally central internal space 28. The upper portion 30 of space 28 is expanded in diameter relative to the lower portion 32 of space 28, an internal peripheral step 34 being present in the inner surface 36 of sidewalls 26, as shown in FIG. 1. Housing top 22 has a plurality of spaced openings 33 down through which cord ends 14 and eyelets 16 pass into central space 28.

2) A cord end retainer 38 is vertically slideably disposed in space 28. Retainer 38 has an upper portion 40 dimensioned to about abut inner surfaces 34 of sidewalls 26 in lower portion 32 of space 28 and retainer 38 has a lower portion 42 which defines a plurality of spaced external pockets 44 releasably receiving and retaining cord lower ends 14 and eyelets 16 when retainer 38 is in lower portion 32 of space 28, as shown in FIG. 1.

Pockets 44 are vertical and extend from lower portion 42 to upper portion 40. Lower portion 42 decreases in diameter in a downwardly direction and preferably is inverted conical. When cord ends 14 and eyelets 16 are in pockets 44 they cannot be released therefrom until retainer 38 moves up from the locked position of FIG. 1 to the released position of FIG. 2, that is, into the expanded upper portion 30 of space 28 wherein there is sufficient space to permit eyelets 16 to pass up between the adjacent sidewall and pockets 44 (FIG. 2). Retainer 38 at its lower end has a tubular extension 46 depending therefrom and out bottom end 24 of housing 20, which extension contains an operating cord 48 which depends therefrom.

3) A coiled spring 50 is disposed vertically in space 28 between the upper end of retainer 38 and the undersurface of top 22. Spring 50 controls the extent of vertical force needed to move retainer 38 from the position of FIG. 1 to the position of FIG. 2, thus releasing cord ends 14 and eyelets 16 from housing 20. This vertical force is encountered when a child entangled in cords 12 struggles to free himself or herself from cords 12. Accordingly, device 18 provides an improved degree of safety against such accidents.

4) Further safety features are also provided in the present device 18. They are as follows:

a) A preferably generally conical cord guide 52 (FIGS. 3 and 5) is releasably or permanently secured to and extends upwardly from the upper surface of upper end 22 of housing 20 and has openings 54 extending vertically therethrough and aligned with openings 33. Cord guide 52 has the effect of keeping cords 12 in untangled parallel alignment, thus facilitating smooth safe operation of cords 12 and device 18.

b) A single, elongated smooth safety rod 56 (FIGS. 1—3) is releasably or permanently secured transversely in housing 20 adjacent the upper end 22 to span space 28 and intersect a single opening 33. Rod 56 permits the unimpeded passage of a cord end 14 but rod 56 is of sufficient diameter so that it blocks the upward passage of an eyelet 16, whereby that eyelet 16 and the cord end 14 to which it is connected cannot pass upwardly out of housing 20, so that housing 20 remains connected to that cord end 14. Thus, a child cannot play with and choke on housing 20, since it does remain connected to assembly 10. Moreover, the single cord end 14 remaining connected to housing 20 does not represent a strangling hazard for a child.

FIG. 6

Figure 6:
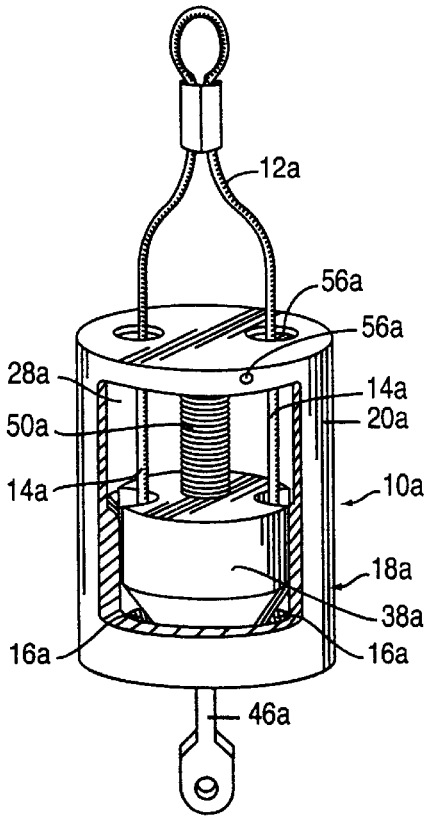
FIG. 6 is a schematic front perspective view, partly broken away, of a second preferred embodiment of the improved assembly of the present invention.

A second preferred embodiment of the improved safety assembly of the present invention is schematically depicted in FIG. 6. Thus, assembly 10i ais shown. Components thereof similar to those of assembly 10 bear the same numerals but are succeeded by the letter "a". Assembly 10*a* is substantially identical to assembly 10, except as follows:

a) a single cord 12*a* is depicted, formed into a loop, with the two lower ends 14*a* terminating in eyelets 16*a;* b) extension 46*a* is integral with retainer 38*a*, depends therefrom and is used as the operating cord; and, c) assembly 10*a* has no cord guide, one not being needed. Assembly 10*a* has the other advantages of assembly 10, rod 56*a* intercepting one of eyelets 16*a* to prevent complete separation of cord 12*a* from housing 20*a*.

FIG. 7

Figure 7:
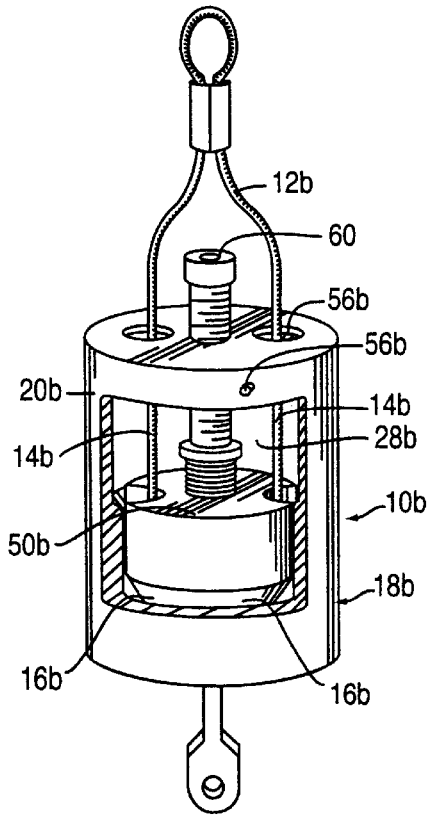
FIG. 7 is a schematic front perspective view, partly broken away, of a third preferred embodiment of the improved assembly of the present invention.
Figure 8:
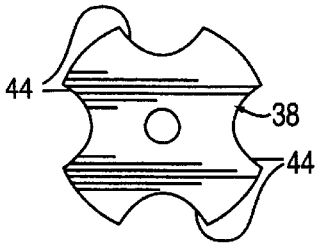
FIG. 8 is a reduced schematic top plan view of the retainer of FIG. 1; and, FIG. 9 is a schematic enlarged side elevation, partly broken away, of a second preferred embodiment of the safety rod of the present invention, shown transversly spanning and releasably secured in the sidewalls of the housing of the assembly of the present invention.

A third preferred embodiment of the improved assembly of the present invention is schematically depicted in FIG. 7. Components thereof similar to any of those of FIGS. 1–6 and 8 bear the same numerals but are succeeded by the letter "b". Safety device 18*b* is substantially identical to device 18*a* except as follows:

Safety device 18*b* includes a screw 60 threaded down through top 22*b* of housing 20*b* into contact with the upper end of coiled spring 50*b*. Screw 60 is sufficiently long so that it can adjustably compress spring 50*b* and thus control the degree of force needed to be exerted upwardly on retainer 38*b* to move retainer 38*b* from the lock position of FIG. 7 to a cord release position comparable to that shown in FIG. 2. This affords an increased measure of safety and convenience.

FIG. 9

Figure 9:
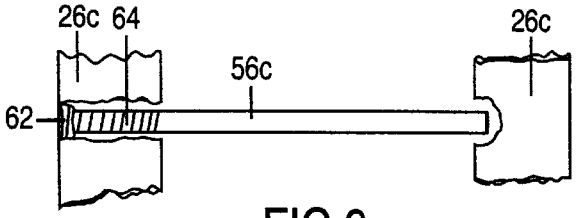

A modified version of the safety rod utilized in the present invention is schematically depicted in FIG. 9. Thus, rod 56*c* is shown and has an expanded screw head 62, a threaded portion 64 of the shank thereof adjacent to head 62 and of a length not exceeding the thickness of a housing sidewall 26*c* bearing a threaded opening 66 therein. The remainder of rod 56*c* is smooth so as not to abrade a control cord (not shown) sliding thereagainst. Rod 56*a* can be easily secured in place and as easily removed thereform when desired.

Thus, the improved cord safety device of the present invention has improved safety features which have been described above and which improve the hazard-free performance of the present assembly. Various other features of the improved assembly and the components thereof and their parameters are as set forth in the foregoing. Various modifications, changes, alterations and additions can be made in the assembly of the present invention and in the safety device thereof and its components. All such modifications, changes, alterations and additions as are within the scope of the appended claims form part of the present invention.

What is claimed is:

1. An improved window covering cord safety assembly, said assembly comprising, in combination:

a) at least one window covering control cord having a free end bearing an expanded eyelet; and, b) a safety device connected to said free end of said control cord and adapted to release said cord free end at a predetermined pull pressure on said cord, said safety device comprising, in combination:

1) a housing having a closed upper end, a closed opposite lower end and sidewalls interconnecting said upper end and said lower end to define a generally central space, said sidewalls having upper and lower portions, the distance between the inner surfaces of said upper portion of said sidewalls being greater than the distance between the inner surfaces of said lower portion of said sidewalls, whereby the upper portion of said space is expanded relative to the lower portion of said space, said housing including an opening in its upper end down through which said control cord and eyelet pass, 2) a retainer slideably received in said space for movement between said lower and upper portions of said space, said retainer having a lower portion defining an external pocket trapping said control cord and eyelet when said retainer is in said lower portion of said space but releasing said eyelet to free said control cord when said retainer pocket is in said upper portion of said space, 3) an operating cord connected to said retainer and extending downwardly through an opening in said housing lower end, 4) a spring positioned in said housing space between the upper end of said retainer and the upper end of said housing and biasing said retainer downwardly in said space, said spring controlling the upward pressure needed to be exerted on said control cord in order to move said retainer to said upper expanded portion of said space to release said control cord from said housing, and, 5) a safety rod spanning said space between said sidewalls, said rod allowing free movement of said control cord but preventing passage of said eyelet out of said housing, thereby preventing full separation of said control cord from said housing.

2. The improved assembly of claim 1 wherein said assembly includes an upper control cord guide mounted on said upper end of said housing and extending thereabove, said guide defining a control cord opening aligned with said opening in said upper end of said housing.

3. The improved assembly of claim 2 wherein said assembly includes a plurality of said control cords spaced from each other and having end eyelets and wherein said control cords and eyelets pass down through spaced openings in said cord guide and said housing upper end and wherein said eyelets are trapped in separate spaced pockets in said lower portion of said retainer until said retainer is moved upwardly against said spring bias to said upper portion of said space, said safety retainer rod preventing the passage of at least one of said eyelets out of said housing and said control cord guide.

4. The improved assembly of claim 2 wherein said operating cord is connected directly to said retainer and wherein said spring is a coiled spring secured to the top of said retainer and the inner surface of the upper end of said housing.

5. The improved assembly of claim 2 wherein the upper portion of said retainer is generally cylindrical, wherein the lower portion of said retainer is generally inverted conical with a central depending rod containing said operating cord and wherein said housing is generally cylindrical and said cord guide is generally conical.

6. The improved assembly of claim 1 wherein said assembly has a pair of said control cords which form a closed connector loop with two leads above said housing.

7. The improved assembly of claim 6 wherein said device includes an adjustable screw threaded down through said housing upper end into contact with the top of said spring, whereby compression of said spring is adjustable to control the force necessary to move said retainer upwardly to said upper portion of said space.

8. The improved assembly of claim 1 wherein said safety rod has a screw head and also has a threaded portion adjacent said head which threaded portion is of a length not exceeding the thickness of said upper portion of said sidewall, the remainder of said rod being smooth and threadless, whereby said rod is releasably secured in said housing.

* * * * *